US005636417A

United States Patent [19]

Eisenkolb

[11] Patent Number: 5,636,417

[45] Date of Patent: Jun. 10, 1997

[54] CURTAIN HOOK

[75] Inventor: Gustaaf J. Eisenkolb, Eindhoven, Netherlands

[73] Assignee: Inprotec International B.V., Bladel, Netherlands

[21] Appl. No.: 501,093

[22] PCT Filed: Oct. 27, 1994

[86] PCT No.: PCT/NL94/00264

§ 371 Date: Oct. 13, 1995

§ 102(e) Date: Oct. 13, 1995

[87] PCT Pub. No.: WO95/11612

PCT Pub. Date: May 4, 1995

[30] Foreign Application Priority Data

Oct. 29, 1993 [NL] Netherlands ..... 9301873

[51] Int. Cl.[6] ..... A47H 13/00

[52] U.S. Cl. ..... 24/716; 24/460; 24/462; 160/346

[58] Field of Search ..... 24/716, 706.1, 24/600.9, 338, 460, 462, 304; 160/346, 347

[56] References Cited

U.S. PATENT DOCUMENTS

| | | | |
|---|---|---|---|
| 2,633,911 | 4/1953 | Rosenbaum | 160/347 |
| 2,772,835 | 12/1956 | Prot | 24/458 |
| 3,178,760 | 4/1965 | Kalal et al. | 160/346 |
| 3,444,595 | 5/1969 | Wachenheimer | 24/716 |
| 4,231,141 | 11/1980 | Derrick et al. | 24/462 |
| 4,454,635 | 6/1984 | Russell | 24/462 |
| 4,682,642 | 7/1987 | Hogshead, III et al. | 24/460 |

FOREIGN PATENT DOCUMENTS

| | | | |
|---|---|---|---|
| 0 290 104 | 11/1988 | European Pat. Off. . | |
| 0042194 | 12/1937 | Netherlands | 24/338 |
| 567 394 | 10/1975 | Switzerland . | |

*Primary Examiner*—Victor N. Sakran
*Attorney, Agent, or Firm*—Young & Thompson

[57] ABSTRACT

A curtain hook comprises a plastic strip (41) and an I-section (42, 43, 44) which is integral therewith and in which the flange (42) facing the strip is provided with at least one sawtooth profile (48), while the other flange (43) is a guide for a runner (45) which grips around it, and to which a hook-shaped element (46) is connected. The runner has at least one projection (47) which engages in the sawtooth profile (48) in order to prevent the runner from being moved in a certain direction, while movement of the runner in the opposite direction is still possible. In order to simplify sewing of the curtain hook into a curtain pleat by machine, the abovementioned other flange (43) of the I-section is narrower than a flange (42) facing the strip.

8 Claims, 1 Drawing Sheet

CURTAIN HOOK

FIELD OF THE INVENTION

The invention relates to a curtain hook, comprising a plastic strip and an I-section which is integral therewith, said I-section having a first flange facing said strip, a second flange being a guide for a runner which grips around it and to which a hook-shaped element is connected, a body between said flanges and at least one sawtooth profile, the runner having at least one projection which engages in the sawtooth profile in order to prevent the runner from being moved in a certain direction, while movement of the runner in the opposite direction is still possible.

BACKGROUND OF THE INVENTION

Such a hook is shown in Dutch Patent Application 9201957 (not a prior publication) in the name of Eisenkolb Confectiemachines B.V. This patent application also describes a device by means of which a curtain hook can be moved automatically to a needle plate below a sewing machine, following which a stop element is operated to prevent the hook from sliding back. In this position of the curtain hook a curtain pleat can be brought in such a way that the strip and the I-section of the curtain hook fall into the pleat. A sewing machine clamp (pressure foot) is then operated in order to fix material and curtain hook, and the curtain hook can be sewn into the curtain pleat, the needle passing through the strip right next to the I-section. Said sewing machine clamp also presses on the runner. It has been found that this causes the hook to go into a slanting position, with the result that the stitching becomes curved and does not run in a straight line at right angles to the curtain edge. Besides, there is relatively little space present between the bottom side of the curtain hook and the needle plate of the sewing machine and between the top side of the curtain hook and the pressure foot of the sewing machine, which can give rise to problems when the curtain pleat is being slid over the curtain hook, in particular if the curtain is made of relatively thick, coarse material.

SUMMARY OF THE INVENTION

The object of the invention is to avoid these drawbacks, and to this end said second flange of the I-section is narrower than said first flange facing the strip.

Since the outer Flange of the I is narrower, the runner can also be made narrower, with the result that when the curtain hook is pressed on the needle plate of the sewing machine the hook does not go into a slanting position, or goes into a much less slanting position, and the stitching can be made in a straight line at right angles to the the curtain hook before the sewing machine clamp (pressure foot) moves down; there is more space between the bottom side of the hook and the needle plate. The other flange is preferably 2.6 mm wide and the flange facing the strip 5 mm wide.

The thickness of the runner (viewed in a direction parallel to the flanges of the I-section) is preferably around 5 mm, which is around 2.3 mm less than before.

The part of the strip facing the I-section preferably has a smooth surface, and the remaining part of the strip is rough. The needle will pass through the smooth part and have much less of a tendency to glance off an uneven part. The stitching becomes more uniform. The rough part is important for producing some friction.

If the smooth part is also made thinner, for example 0.3–0.5 mm instead of 0.5–0.7 mm, said part becomes more readily bendable, which is important when positioning a flat pleat or a pinch pleat; for the strip can be bent away relative to the I-section, with the result that the abovementioned special pleats can be flatter and look more attractive.

In order to simplify even further the slipping of a curtain pleat over a curtain hook, the end of the strip to which the runner can be moved is rounded both widthwise and as regards thickness.

BRIEF DESCRIPTION OF THE DRAWINGS

The invention will now be explained in greater detail with reference to the Figures.

DETAILED DESCRIPTION OF THE PREFERRED EMBODIMENTS

Figure 1:
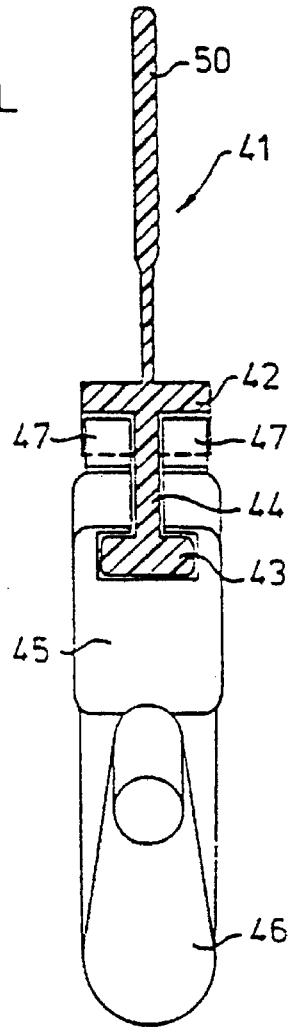
FIG. 1 shows a section through the curtain hook according to the invention.
Figure 2:
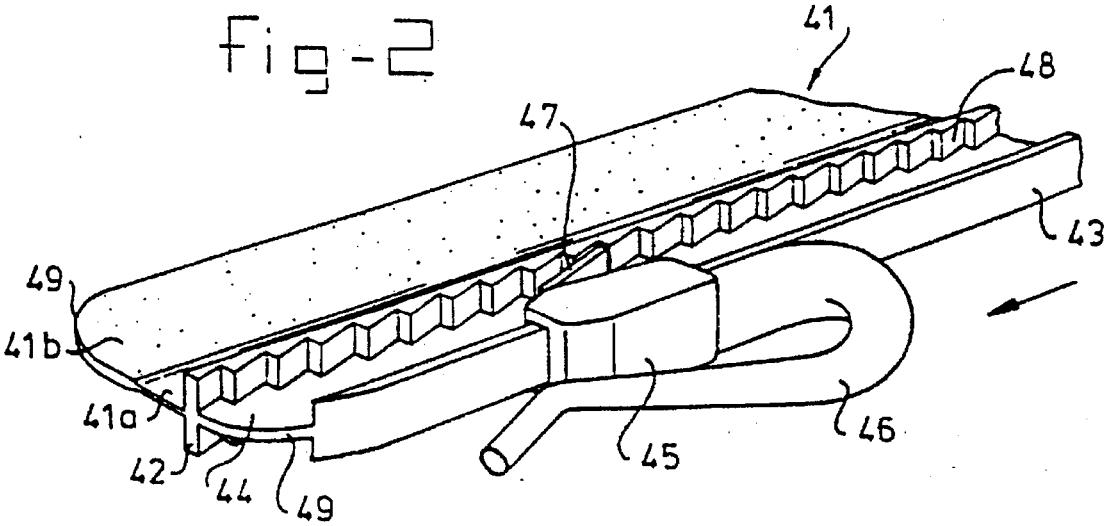
FIG. 2 shows a perspective view of the curtain hook.

The curtain hook shown consists of a plastic strip 41, and an I-section which is integral therewith and consists of two flanges 42, 43 and a body 44, and also a runner 45 which grips over the flange 43 and has hook-shaped element 46 and two barbed pins 47 which engage in a sawtooth profile 48 formed on the flange 42 of the I-section. The pins 47 ensure that the runner 45 can move only in the direction of the arrow, and not in the opposite direction.

The following are important for the invention:

that the flange 43 is of lower width than the flange 42 (width of the flange 43 is, for example, around 2.6 mm, and that of flange 42 around 5 mm), that the runner 45 is relatively low in width (for example, around 5 mm, instead of 7.3 mm), that the strip 41 has a part 41*a* with smooth surface adjoining the I-section 42, 43, 44 and a part 41*b* with friction-producing rough surface, that the smooth part 41*a* is less thick (around 0.4 mm) than the rougher part (thickness around 0.6 mm) and is thus more bendable, and that the end of the strip, viewed in the direction of the arrow (which is the direction of movement of the runner 45), is rounded in the widthwise direction (see 49) and as regards thickness (see 50).

These measures contribute to beautifully straight stitching and make the needlewoman's task easier. As a result of the low width of the flange 43 and the correspondingly low width of the runner 45, if a pressure plate of a sewing machine presses on the hook, the hook will undergo little or no bending, with the result that the stitching becomes beautifully straight. The smooth finish of the part 41 makes that part more suitable for straight stitching, because the needle does not glance off an uneven part. The low thickness of that thin part makes the flange bendable, as a result of which the strip can be bent away relative to the I-section when positioning flat pleats and pinch pleats, and those pleats can thus be flatter and more attractive in appearance.

The rounding at one end of the curtain hook helps to make it easier to slide a curtain pleat over a curtain hook.

I claim:

1. A curtain hook comprising:

a plastic strip to be sewn onto a curtain pleat, an I-section integral with said plastic strip, said I-section having a first flange extending perpendicular to and facing said plastic strip, a second flange being a guide for a runner and extending perpendicular to said plastic strip and turning away from said plastic strip, a web between said first and second flanges and extending parallel to said plastic strip, and at least one sawtooth profile to prevent said runner from being movable in one direction, while permitting movement of said runner in an opposite direction, said second flange of said I-section being narrower than said first flange around which said runner grips.

2. Curtain hook according to claim 1, characterized in that the width of the runner (45) is about the same as the width of the first flange (42).

3. Curtain hook according to claim 1, characterized in that the second flange (43) is around 2.6 mm wide, and the first flange (42) facing the strip is around 5 mm wide.

4. Curtain hook according to claim 3, characterized in that the width of the runner (45) is around 5 mm.

5. Curtain hook according to claim 1, characterized in that a part (41*a*) of the strip (41) facing the I-section has a smooth surface, and the remaining part (41*b*) of the strip has a rough surface.

6. Curtain hook according to claim 5, characterized in that the smooth part (41*a*) of the strip is thinner and thereby more readily bendable than the rough part of the strip (41).

7. Curtain hook according to claim 6, characterized in that the thickness of the smooth part (41*a*) is 0.3–0.5 mm and the thickness of the rough part (4l*b*) is 0.5–0.7 mm.

8. Curtain hook according to claim 1, characterized in that an end of the strip to which the runner is movable is rounded (49, 50) both widthwise and in terms of thickness.

* * * * *